US008477078B2

(12) United States Patent
Ludwick

(10) Patent No.: US 8,477,078 B2
(45) Date of Patent: Jul. 2, 2013

(54) QUADLOCK

(75) Inventor: Clifford Alvin Ludwick, Loganville, GA (US)

(73) Assignee: Al Ludwick, Loganville, GA (US)

( * ) Notice: Subject to any disclaimer, the term of this patent is extended or adjusted under 35 U.S.C. 154(b) by 242 days.

(21) Appl. No.: 12/908,898

(22) Filed: Oct. 21, 2010

(65) Prior Publication Data

US 2012/0098731 A1 Apr. 26, 2012

(51) Int. Cl.
*H01Q 1/08* (2006.01)

(52) U.S. Cl.
USPC ..... 343/881; 343/874; 343/882

(58) Field of Classification Search
USPC ..... 343/881, 890, 874, 882
See application file for complete search history.

(56) References Cited

U.S. PATENT DOCUMENTS

| | | | | |
|---|---|---|---|---|
| 5,379,048 | A * | 1/1995 | Kaufman | 343/765 |
| 6,342,861 | B1 * | 1/2002 | Packard | 343/741 |
| 6,692,142 | B1 * | 2/2004 | Gordin et al. | 362/431 |
| 7,015,872 | B1 * | 3/2006 | Little | 343/890 |
| 7,432,875 | B1 * | 10/2008 | Sergi | 343/890 |
| 2004/0196207 | A1 * | 10/2004 | Schefter et al. | 343/878 |

* cited by examiner

*Primary Examiner* — Hoanganh Le

(57) ABSTRACT

Maintenance on a high frequency Amateur Radio cubical quad antenna mounted on a tilt over tower typically requires the use of a ladder of scaffold. While tiltover towers are common, when used with a cubical quad antenna the tilting is limited by size of the cubical quad elements. The user must still utilize a ladder, scaffold or other device to reach all points on the antenna. The QuadLock addresses this issue and allows the tower and antenna to be tilted all the way to ground level for maintenance.

4 Claims, 3 Drawing Sheets

QuadLock

QuadLock

Operational position.
QuadLock LOCK engaged.

QuadLock

End view

Tower in maintenance position
QuadLock LOCK dis-engaged.
Elements rotated.

QUADLOCK

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

The cubical quad describes one type of Amateur Radio antenna for high frequency transmission and reception of radio signals. The high frequency quad is made up of two or more elements attached to a boom. Each element consists of a hub structure mounted to the boom with element poles in the shape of an X radiating from the hub. The actual electrical component of the antenna consists of wire suspended on the element poles in a square or loop. The entire assembly of multiple elements attached to the boom is typically mounted on a radio tower. These towers may be of the tilt over type which is intended to facilitate maintenance on or near the ground. The cubical shape of the quad antenna prevents tilting the tower to ground level. This results in the use of ladders or scaffolds to reach all points on the antenna. A simple mechanism to facilitate tilting the tower to ground level for antenna maintenance is not available.

BRIEF SUMMARY OF THE INVENTION

The QuadLock replaces the typical element hub support structure. The QuadLock will allow the individual elements of the quad antenna to swivel or rotate such that the elements become parallel to the boom when the tower is tilted over. This allows the antenna to be lowered until it is at ground level for maintenance. The swiveling element plate is held in position with the element at a right angle to the boom when the tower is in the normal operating position. The locking mechanism will engage as the tower is tilted up to the vertical operational position and disengage as the tower is tilted down to the horizontal maintenance position. The use of this invention is not limited to amateur radio antennas but can be applied to any cubical quad type antenna.

DETAILED DESCRIPTION OF THE INVENTION

Figure 1:
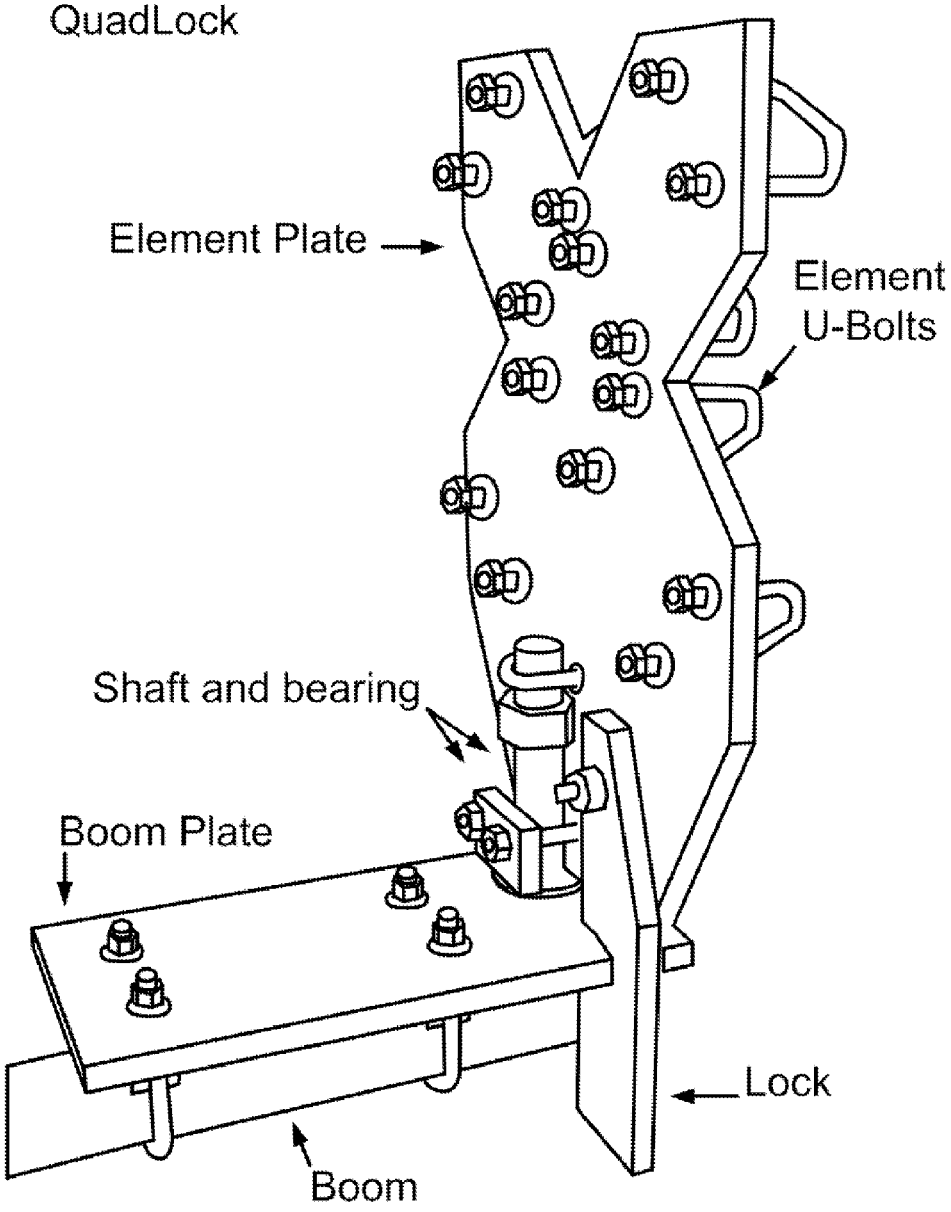
FIG. 1 describes the QuadLock which is comprised of two aluminum plates, the boom plate and the element plate.
Figure 2:
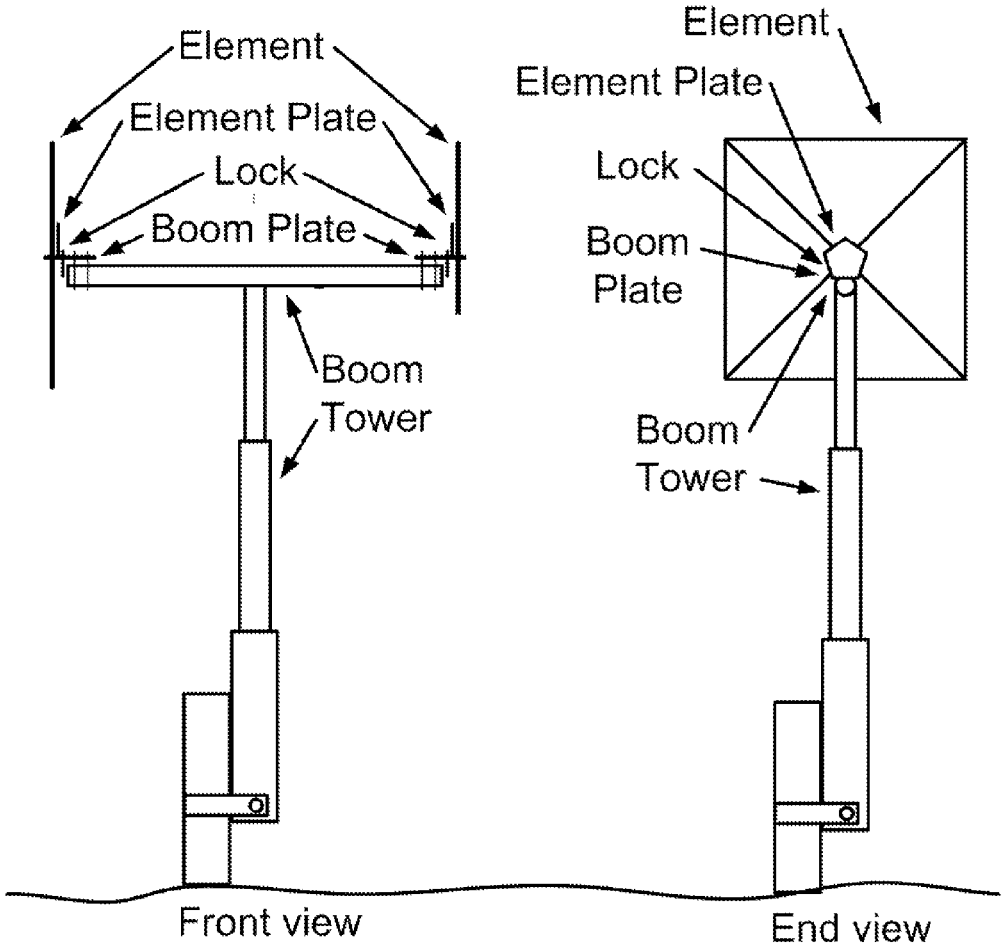
FIG. 2 describes how the boom plate attaches to the antenna boom and tower and provides a platform for the rotatable element plate. The boom plate attaches to the boom with u-bolts. The element plate is attached to the boom plate by a shaft and thrust bearings. The element plate is free to rotate except when locked in place by the lock plate. The element plate provides a platform for attaching the poles used to suspend the loop wiring. The element poles are attached to the element plate with u-bolts. The element plate is locked at a right angle to the boom when the lock is engaged. The lock plate is free to rotate as the tower is raised and lowered and the lock is gravity operated. The lock plate rotates into the slot in the boom plate and engages as the tower is tilted up to the operational position.
Figure 3:
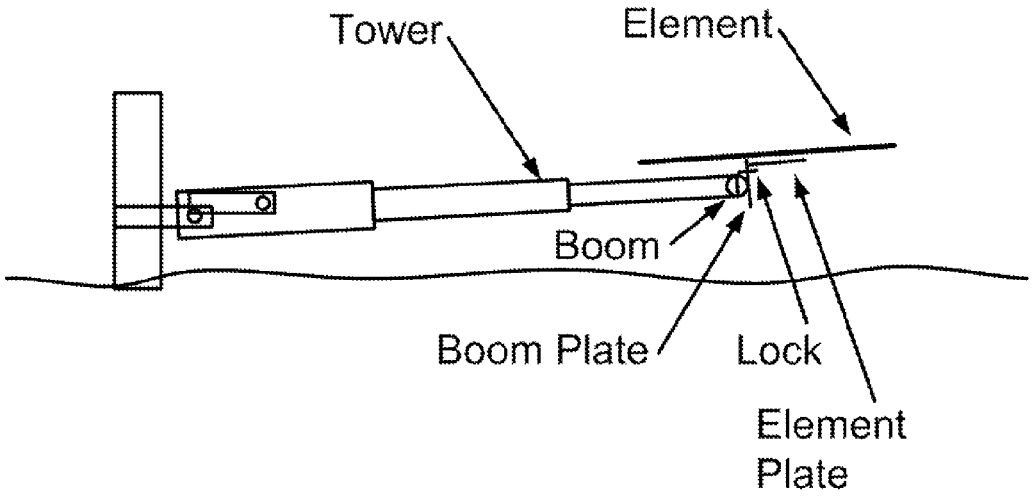
FIG. 3 describes how the lock plate rotates out of the slot in the boom plate and disengages as the tower is tilted over to the horizontal maintenance position allowing elements to swivel.

The QuadLock replaces the typical element hub support structure on a quad antenna. The QuadLock will allow the individual elements of the quad antenna to swivel or rotate such that the elements become parallel to the boom when the tower is tilted over. The QuadLock is made of two aluminum plates, the boom plate and the element plate. The plates are of sufficient size to support the weight of the element and the force of wind. The plates are made from aluminum to keep the weight to a minimum. The mechanism will withstand the vertical and torsional forces of the elements. The boom plate attaches to the antenna boom using u-bolts and provides a platform to mount the swiveling element plate. The element plate is attached to the boom plate by a shaft and thrust bearings. The element poles are attached to the element plate with u-bolts. The antenna loop is attached to the element poles. The element plate is perpendicular to the boom when the tower is in the vertical operational position. The element plate is held in place by a locking mechanism.

The lock is gravity powered and automatic and does not require the user to climb the tower to operate the lock. The lock plate is free to rotate as the tower is raised and lowered. The lock plate rotates into the slot in the boom plate and engages as the tower is tilted up to the operational position. The lock plate rotates out of the slot in the boom plate and disengages as the tower is tilted over to the horizontal maintenance position. The operator can manually rotate the element parallel to the boom as the tower is lowered. The gravity powered locking mechanism eliminates the need for a manual locking mechanism. It eliminates the need to use a ladder or scaffold to access the locking mechanism.

Other solutions to this maintenance problem utilize trams or pulley systems to lower the antenna to the ground. A ladder, scaffold, or other device is often still needed with these solutions.

The invention claimed is:

1. A QuadLock providing a unique mechanism for a cubical quad antenna tower comprising:

a boom plate for attaching to an antenna boom;

a movable plate for attaching an electrical antenna element;

a pair of thrust bearings attached to the boom plate; and a shaft for attaching the movable plate to the thrust bearings that allows the movable plate to swivel freely when the antenna element and tower are lowered all the way to ground level.

2. The QuadLock according to claim 1, wherein the QuadLock provides a mechanism that locks the movable plate at a right angle to the antenna boom when the antenna element and tower are in the vertical operational position.

3. The QuadLock according to claim 1, wherein the QuadLock provides a mechanism that unlocks the movable plate and allows the movable plate to swivel parallel to the antenna boom when the antenna element and tower are lowered to the horizontal maintenance position.

4. The QuadLock according to claim 1, further comprising: a gravity powered lock comprising of a rotatable lock plate, an attachment bolt, and a lock slot wherein the rotatable lock plate is attached to the moveable plate, the lock slot on the boom plate is shaped to engage the lock plate when the tower is tilted up to the operational position, and the lock plate disengages as the tower is tilted to the horizontal position which allows the antenna element to swivel parallel to the antenna boom.

* * * * *